US008242667B2

(12) United States Patent
Gruber

(10) Patent No.: US 8,242,667 B2
(45) Date of Patent: Aug. 14, 2012

(54) FOLD AND SPIRAL CFL BULB SAFETY CUPS, DIFFUSION COVERS AND SHADE ASSEMBLIES

(75) Inventor: Karl L. Gruber, Port Ludlow, WA (US)

(73) Assignee: Diversified Electronics LLC, Port Ludlow, WA (US)

( * ) Notice: Subject to any disclaimer, the term of this patent is extended or adjusted under 35 U.S.C. 154(b) by 15 days.

(21) Appl. No.: 13/014,775

(22) Filed: Jan. 27, 2011

(65) Prior Publication Data

US 2011/0181172 A1 Jul. 28, 2011

Related U.S. Application Data

(60) Provisional application No. 61/298,847, filed on Jan. 27, 2010.

(51) Int. Cl.
*H01J 1/02* (2006.01)

(52) U.S. Cl. ..... 313/25; 313/312

(58) Field of Classification Search ..... 313/25, 313/116, 312, 493, 634
See application file for complete search history.

(56) References Cited

U.S. PATENT DOCUMENTS

| | | | |
|---|---|---|---|
| 536,856 | A | 4/1895 | Dion |
| 843,903 | A | 2/1907 | Lungren |
| 1,042,979 | A | 10/1912 | Seessle |
| 2,066,771 | A | 1/1935 | Doane |
| 3,757,105 | A | 9/1973 | McCarthy |
| 4,733,123 | A | 3/1988 | Zwald |
| 4,871,944 | A | 10/1989 | Skwirut et al. |
| 4,878,159 | A | 10/1989 | Blaisdell et al. |
| 5,980,068 | A | 11/1999 | Yu |
| 6,296,375 | B1 | 10/2001 | Sung et al. |
| D478,393 | S | 8/2003 | Alduby |
| D479,894 | S | 9/2003 | Alduby |
| 7,201,491 | B2 | 4/2007 | Bayat et al. |
| 7,501,589 | B1 | 3/2009 | Graham |
| 7,798,674 | B2 | 9/2010 | Bernhardt et al. |
| 2003/0147243 | A1 | 8/2003 | Alduby |
| 2009/0103313 | A1 | 4/2009 | Bernhardt |
| 2009/0251896 | A1 | 10/2009 | Conaway |
| 2009/0257235 | A1 | 10/2009 | Wipper |
| 2010/0002451 | A1 | 1/2010 | Reynolds |
| 2010/0149813 | A1 | 6/2010 | Powell |

*Primary Examiner* — Vip Patel
(74) *Attorney, Agent, or Firm* — Jacques M. Dulin, Esq.; Innovation Law Group, Ltd.

(57) ABSTRACT

Screw-on or slip-on covers, in the form of transparent or translucent plastic sleeves for CFLs functioning as diffusers and cups for handling bulbs during installation, removal and as a safety receptacle for mercury-contaminated broken bulbs. The covers have interior surfaces contoured to the various sizes of CFL tube configurations, spiral or axially folded tubes, so that they are securely retained when screwed or slipped onto the tubes. The inventive covers may be used in any orientation, open end up, down or horizontal, so that they are equally useful for upright CFLs in lamps, horizontally oriented CFLs screwed into wall sockets, or downwardly oriented or angled CFLs screwed into horizontal or sloped ceiling fixtures. The inventive covers function as light diffusers and hide the tubes in more pleasing external shapes. Attractive sleeve colors, designs and surface textures are disclosed. Shades and shade frames may be secured to the inventive CFL covers.

20 Claims, 7 Drawing Sheets

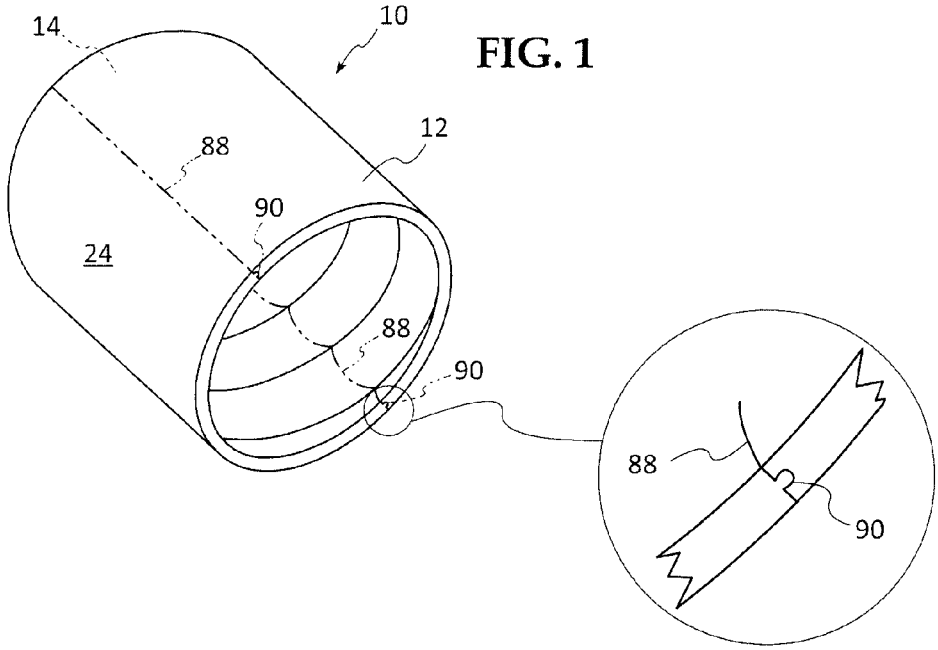
FIG. 1
FIG. 1A
FIG. 2A
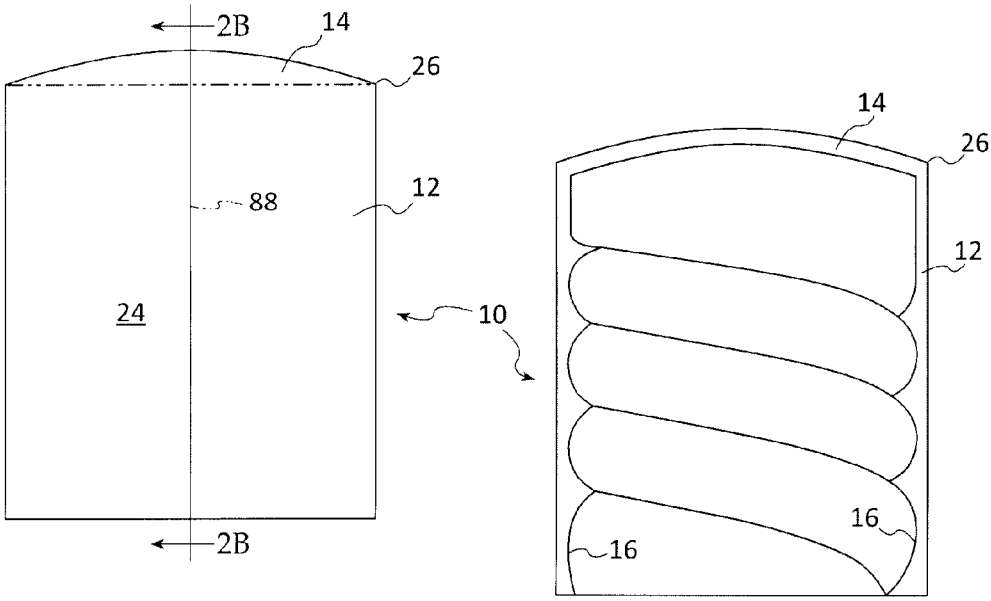
FIG. 2B

FIG. 3
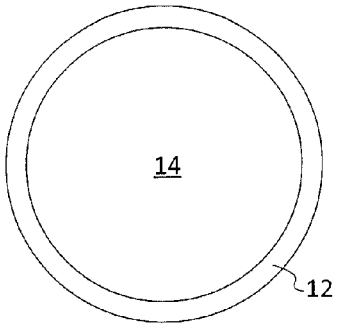
FIG. 4
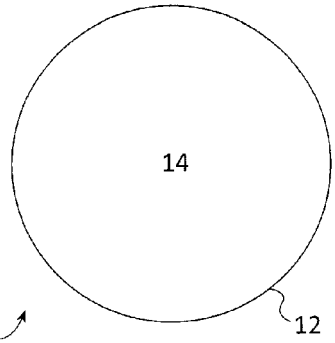
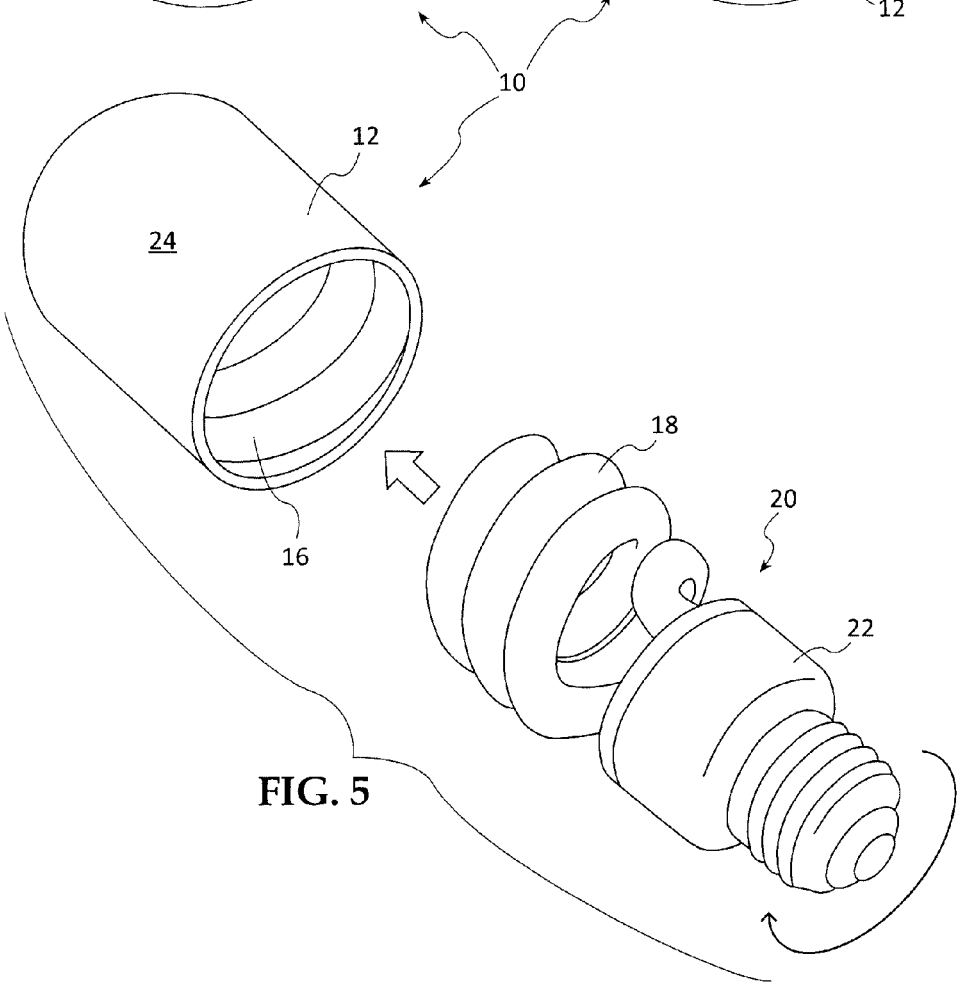
FIG. 5

FOLD AND SPIRAL CFL BULB SAFETY CUPS, DIFFUSION COVERS AND SHADE ASSEMBLIES

CROSS-REFERENCE TO RELATED APPLICATION

This is the Regular US application corresponding to a U.S. Provisional Application Ser. No. 61/298,847, entitled Folded and Spiral-Tube Type Fluorescent Bulb Diffusion Cover and Shade Assemblies filed by the same inventor on Jan. 27, 2010, the priority of which is claimed under 35 US Code Sections 119, 120, ff.

FIELD

The application is directed to screw-on or slip-on covers, in the form of transparent or translucent plastic sleeves or cups, for folded-tube and spiral-tube type fluorescent bulbs, including CFL bulbs, which function as diffusion covers while hiding the tubes in more pleasing shapes, and at the same time serving as safety cups to assist in handling the bulbs during installation and removal, while serving as a safety receptacle for broken bulbs. A wide range of attractive sleeve colors, designs and surface textures are disclosed. Shades and shade frames may be secured to the inventive sleeves. The sleeve color can be selected to provide warmer spectral light output.

BACKGROUND

Folded and spiral-tube screw-in compact fluorescent (CFL) bulbs are in wide use today, par-ticularly as they are popular as energy-saving, nominally "green" alternatives to incandescent bulbs, since they provide equivalent light lumens at lower wattage and their service life is longer. For example, typical 13 watt fluorescent bulbs are equivalent replacements for 60 watt incandescent bulbs, and 26 watt fluorescents replace 100 watt incandescent bulbs. In addition, the fluorescent bulbs operate much cooler, and can be handled even after being ON for several hours without burning the skin. Indeed, more folded and spiral-tube type screw-in fluorescent bulbs are sold than incandescent bulbs.

The spiral tube CFL bulb was invented in 1976 by Edward E. Hammer, an engineer with General Electric, in response to the 1973 oil crisis, but the invention was shelved. The design was eventually copied by others.[1] It was not until 1995 that spiral CFL bulbs manufactured in China were commercially available. In 1980, Philips introduced its model SL, which was a screw-in bulb having an integral ballast. The SL bulb used a folded T4 tube, stable tri-color phosphors, and a mercury amalgam. This was the first successful screw-in replacement for an incandescent lamp. However, it was not until 1985 that the market really took off as a result of the introduction by the Osram company of the first CFL having an electronic ballast. The electronic ballast reduced the flickering and hum of the standard fluorescent tube ballasts. Today CFL bulbs fit in the same volume as standard incandescent bulbs as a result of new, high efficiency phosphors that permit more power per unit area per lumen, thereby permitting reduction in bulb size. CFLs typically radiate light in a different spectral range than that of incandescent bulbs. Improved phosphor formulations have resulted in the perceived color of soft-white CFL bulb light to be on par with standard incandescent lamps.

The average rated life of a CFL is between 8 and 15 times that of incandescent bulbs. CFLs typically have a rated lifespan of between 6,000 and 15,000 hours, whereas incandescent lamps are usually manufactured to have a lifespan of 750 hours or 1,000 hours. Although CFLs produce less light later in their lives than when they are new, the light output decay is exponential, with the fastest losses being soon after the lamp is first used. By the end of their lives, CFLs can be expected to produce 70-80% of their original light output, but since the response of the human eye to light is logarithmic, the CFL late-in-life 20-30% light output decline will be compensated for by the eyes.

For a given light output, CFLs use 20 to 33 percent less power than equivalent light-output incandescent bulbs. Since lighting accounted for approximately 9% of household electricity usage in the United States in 2001, widespread use of CFLs can save as much as 7% of total US household power, hence the phase-out of incandescent bulbs has been mandated by the government.

However, like all fluorescents, CFL bulb tubes contain a coating of a mercury amalgam and complex phosphors. While this coating accounts for the improved energy efficiency of CFLs, it seriously complicates their disposal, especially in cases where tubes are broken, as both are hazardous materials. Current CFLs sold are in large percentage, bare bulbs, with no means of proper pick-up, handling and disposal of broken, phosphor/mercury amalgam-coated glass shards. At best the manufacturers, distributors, sellers and government safety agencies simply rely on a warning to the consumer that they contain mercury and the consumer should take care to "properly dispose of used or broken bulbs". Many refuse pick-up services decline to handle broken or used fluorescent bulbs, whether the standard 2'-4' tubes, or the folded/spiral CFLs.

In addition, most people find the shape and folds of the folded-tube fluorescent bulbs to be unacceptable, if not downright ugly, from aesthetic and design viewpoints. Accordingly, some fluorescents are being offered that are encased or encapsulated in translucent white plastic or glass covers that mimic traditional incandescent light bulb shapes. These covers are formed secured to the metal thread base, and are spaced from the folded fluorescent tubes of the bulbs. As a result, the bases are enlarged, and do not fit in many lamp sockets. Accordingly, there remain a vast number of bare spiral and folded-tube bulbs in use that are not the preference of users and present a disposal and breakage hazard. In addition, those covers cause light loss, requiring the consumer to use higher-wattage CFLs, thereby defeating the cost savings. Indeed, in some cases users retain incandescent bulbs rather than use the spiral or folded-tube fluorescents because of light loss, design or aesthetic considerations.

Finally, fluorescent bulb light output is perceived as harsh, cold and giving a greenish tinge to objects illuminated. It can be particularly objectionable as not providing warmth to skin tones.

Accordingly, there is a need in the art for a way that permits covering of folded or spiral-tube CFL bulbs to make them safe to handle during installation, removal and clean-up when broken, are design and aesthetically acceptable, permit use of small bases in screw-in socket assemblies that have small clearance constraints, yet are inexpensive, easy to manufacture, and permit a wide range of design variations, including decorative and functional shades.

THE INVENTION

Summary

Including Objects and Advantages

The invention is directed to screw-on or slip-on covers, in the form of translucent or transparent plastic sleeves, cups or shells, for spiral-tube and folded-tube fluorescent bulbs (herein CFLs) that have a threaded base for screwing into sockets, or pin-type or bayonet-type bases. The inventive covers have interior surfaces that are contoured to the various sizes of CFL tube configurations, whether spiral or axially folded tubes, so that the sleeves or cup-shaped covers screw-onto or slip-onto the tubes with the sleeve/cup interior surface engaging the tubing so as to securely retain the cups on the CFL tubes in use.

The inventive sleeve and cup covers may be used in any orientation, such as open end up, down or horizontal, so that they are equally useful for upright CFLs in lamps, horizontally oriented CFLs screwed into wall sockets, or downwardly oriented or angled CFLs screwed into horizontal or sloped ceiling fixtures.

It is a key feature of the invention that in the cup configuration, the inventive covers serve as a receptacle for retaining broken bulb shards without coming into contact with the bare hands of the user. As such the receptacle can be disposed-of safely without skin contact of the phosphors and mercury components. In addition, the receptacle, being initially threaded onto or slipped over the spiral or folded glass bulb tubing, provides a safe way for the user to handle the bulbs during the installation or removal. Thus, should the bulb break while being screwed-into a socket, the user's hand is contacting the outer surface of the inventive cover cup form, rather than bare hands on the bulb glass as it breaks. This is a valuable safety feature, preventing cuts and skin contact with contaminants.

The inventive covers also provide a second primary function as light diffusers, while hiding the CFL bulb tubes in more pleasing external shapes. A wide range of attractive sleeve colors, designs, surface configurations and surface textures are disclosed. Shades and shade frames may be secured to the inventive CFL covers. The material of the inventive CFL covers may be any suitable thermosetting or thermoplastic plastic polymer or co-polymer that can be molded or machined into suitable interior and exterior configurations, the interior configuration being smooth to slidingly engage the glass tubing of the CFL without scratching or breaking the glass, and the exterior being formed into any suitable shape desired from the aesthetic and design perspective. Exemplary implementations of aesthetic shapes include: generally cylindrical; flame-tip shaped; and traditional light bulb shaped; with a wide range of body color, surface configurations, shapes, and textures.

The preferred plastic is transparent or translucent, to a degree that it hides the CFL tubing shape, yet permits a very high percentage of light transmission there-through, without significant dimming. The plastic may include fillers, extenders, dyes, plasticizers, and UV inhibitors to select or condition the light wavelength and lengthen the service life by preventing splitting or deterioration of the plastic. The plastic should be thermally stable at the operating temperature of the bulbs, and preferably include flame retardants or flame propagation suppressor components. In addition the plastic should have a relatively low coefficient of thermal expansion, so that the sleeves or cups do not expand under bulb service temperatures by an amount that causes them to slip off. For example, the inventive sleeve may be made from a polyolefin, polystyrene, polyvinylchloride, acrylic or polycarbonate polymer (including co-, ter-, or multi-monomer plastics).

The colors of the inventive sleeves may be selected to provide more pleasing tone balance. For example, a preferred embodiment, the plastic is transparent acrylic that contains a dye that softens the light and shifts the perceived wavelength to a warmer color, Bastard Amber being one of the preferred colors. Thus, the inventive sleeves function to shift the color balance of the light spectrum of the CFL bulb/sleeve combination.

In a first embodiment, an inventive cover is a cup (a sleeve with a closed outer end) configured for a spiral-tube CFL, the interior surface of which is configured with broad shallow threads of a size permitting the cup to be screwed-onto the spiral tube of the CFL, covering the CFL tubing down to the ceramic, plastic or metal base of the CFL. The exterior is a smooth generally cylindrical shape, and the outer end is closed and slightly domed. The intersection of the side wall with a dome end may be a crisp edge, or it may be a smooth chamfered curve. The cup depth and number of internal threads is selected so that the cup depth substantially matches the height of the glass tube spiral of the CFL and the two vertical stems leading to the CFL base. This depth provides a safety factor to protect the hands during installation or removal, and to handle a bulb that is broken in service without the need to touch the glass tubing or broken shards as they are retained in the cup.

The plastic is selected to be transparent (clear) or translucent and to have sufficient heat resistance that the service-warmed CFL tubing does not melt or otherwise deform the cup plastic or cause it to expand and slip off the bulb tubing. The cup plastic may have any desired color, such as crystal clear transparent, cool translucent white, or transparent or translucent colors such as Bastard Amber, ivory, party or holiday colors such as red, green, blue, yellow, orange, lavender, and the like, of any selected hue. Colored designs may be cast or painted onto the cup exterior, such as orange and black spirals for Halloween, snowflake designs and the like.

In a second embodiment, the cup is deeper than the height of the CFL spiral so that there is a head space between the top of the bulb and the inside face of the cup. This permits installing a metal or plastic threaded coupling tube or rod into the axial center of the cup from the outside end, and the fastening of a radially extending plastic, fabric, metal or glass shade by use of a finial nut screwed onto the projecting coupling. There are two variations of this embodiment: A) where the threaded coupling is formed integral with the exterior of the cup end; and B) where the cup end is bored and threaded to receive a standard, or provided, tubular threaded coupling as a retrofit assembly. In the B-variation of this embodiment, the coupling is threaded into the cup center hole, a keeper nut is threaded on the coupling inside the cup, a shade having a center hole or other cross-piece with a hole is placed over the exterior projecting end of the coupling and finally a finial is threaded over the projecting coupling end.

In a third embodiment, the cup may include key-hole or other shaped slots formed in or through the side wall of the cup, into which shade stand-off ribs may be inserted for suspending a shade from the cup exterior. Optionally, a double-ended key hole slot may be used, so that the cup is universally useful to retain a shade for a lamp mounted or ceiling mounted CFL bulb.

In a fourth embodiment, the cup may include an upraised external flange adjacent the open end of the outer wall face, and a separate decorative, hollow bulb-shaped cover element is slipped over the cup to engage and be retained by the flange groove. Optionally, the inside surface of the decorative bulb element may be partially silvered, which configuration is particularly useful for hanging lamps, such as dining table lamps, where the bulbs hang down, and the silvered "bottom" shields the eye, and redirects the light for diffuse ceiling lighting.

In a fifth embodiment, another variation of the fourth, the decorative hollow bulb shaped cover may be a "flame bulb"

shape to convert otherwise ugly screw-in spiral fluorescents bulbs to the more decorative flame bulb shape. Such covers may be subtly grooved and shaded or painted to mimic flames.

In a sixth embodiment, the bottom, closed end of the cup may be removable, formed of a snap-in or screw-in disc which may be removed to form a true sleeve configuration, as the user determines for a particular usage. The removal permits forming a generally conical spot of brighter light to emanate from the now-open end of the sleeve, while the sides remain diffuse due to the presence of the sleeve screwed or slipped-onto the CFL tubing.

While the embodiments of the inventive diffuser cups and sleeves have been described in connection with spiral-tube CFLs for screw-on use, one of ordinary skill in the plastic arts will recognize that it is straightforward to configure the inner walls of the inventive cups and sleeves with grooves matching the spacing, depth and tube sizes of the folded-tube type CFL bulbs so that they can be slipped-on or snapped-onto such type of CFLs.

In another embodiment of the invention, the cups are provided already mounted, that is slipped onto or screwed onto the folded or spiral CFL glass tubing, as a combined assembly. A plurality of cups of different colors may be packaged together as an assortment, or a suitable color of cups may be supplied pre-assembled on CFL bulbs as a package, such as a 6-pack. In still another embodiment, a separate keeper may be snapped or glued in place over the open top of the cup after assembly on the bulb so that the cup may not be unscrewed from the bulb, that is, the inventive cup is a permanent integral part of the CFL bulb and cup assembly.

BRIEF DESCRIPTION OF THE DRAWINGS

The invention is described in more detail with reference to the drawings, in which:

FIG. 1 is an isometric view of an inventive cover in the form of a cup showing the broad threaded-contour interior wall;

FIG. 1A is an enlarged section of the rim of the cup showing the parting line and snap-together shoulders;

FIG. 2A is a side elevation of the inventive cup cover of FIG. 1;

FIG. 2B is a section view through line 2B-2B of FIG. 2A;

FIG. 3 is an end view of the open end of the cup of FIG. 1;

FIG. 4 is an end view of the exterior closed end of the cup of FIG. 1;

FIG. 5 is an exploded isometric showing how the inventive cup is screwed onto the spiral CFL bulb tubing;

DETAILED DESCRIPTION

Figure 6:
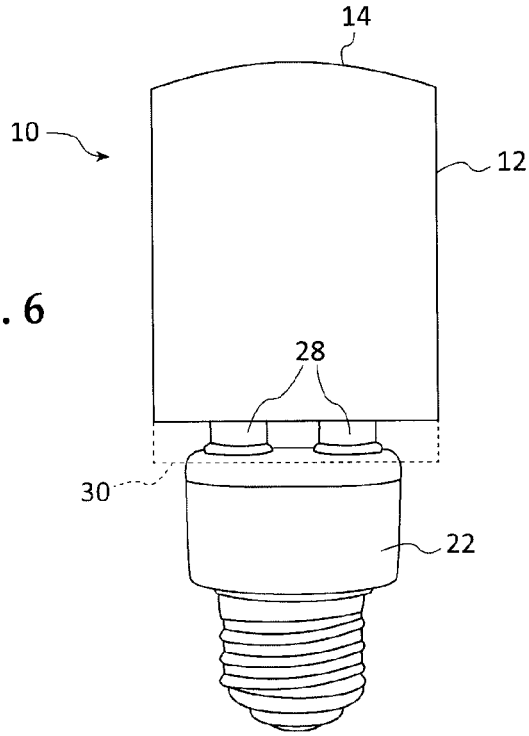
FIG. 6 is a side elevation showing the inventive cup mounted on a spiral tube CFL.

Including the Best Modes of Carrying Out the Invention

The following detailed description illustrates the invention by way of example, not by way of limitation of the scope, equivalents or principles of the invention. This description will clearly enable one skilled in the art to make and use the invention, and describes several embodiments, adaptations, variations, alternatives and uses of the invention, including what is presently believed to be the best modes of carrying out the invention.

In this regard, the invention is illustrated in the several figures, and is of sufficient complexity that the many parts, interrelationships, and sub-combinations thereof simply cannot be fully illustrated in a single patent-type drawing. For clarity and conciseness, several of the drawings show in schematic, or omit, parts that are not essential in that drawing to a description of a particular feature, aspect or principle of the invention being disclosed. Thus, the best mode embodiment of one feature may be shown in one drawing, and the best mode of another feature will be called out in another drawing.

Referring to FIGS. 1-6, in a first embodiment, inventive cover 10 is a generally tubular sleeve 12 having an outer end 14 closed to form a cup or shell. The interior wall of the sleeve 12 is configured with broad shallow threads 16 as a negative of the CFL glass lighting tube elements, thereby being sized to permit the sleeve to be screwed-onto the spiral tube 18 of the CFL 20, covering to the ceramic, plastic or metal base 22 of the CFL. The exterior surface 24 is a smooth generally cylindrical shape, and the outer end 14 is closed and slightly domed. The intersection of the side wall with the dome end may be a crisp edge 26, or it may be a smooth chamfered curve.

FIG. 2B is the section view of the internal threads 16 of the shell 12; FIGS. 3 and 4 show the open and closed ends, respectively, while FIG. 5 shows how the bulb is screwed into the sleeve 12.

FIG. 1 also shows an optional 2-part construction, in which the cups are molded in snap-together halves along a part line 88, shown in FIGS. 1, 1A and 2A. The join between halves preferably have mating shoulders 90 with suitable rib and groove configuration to press fit the halves together (snap-together), the shoulders being shown in enlarged end view in FIG. 1A.

As best seen in FIG. 6, the cup depth (or height) and number of internal threads 16 is selected so that the cup depth substantially matches the height of the spiral glass tube 18 of the CFL and the two vertical stems 28 leading to the CFL base. The user may leave a portion of the stems 28 exposed if desired, or the inventive cover may be screwed down to the base 22 as shown by the dashed line representing the open end 30 of the inventive cover cup 10.

In preferred mode of use in a retrofit situation (that is a non-preassembled mode), the cup is first screwed onto the CFL spiral tubing, and then the combined assembly is screwed into the socket. Thus, the user is using the inventive cup as a holder of the bulb to screw it into the socket, which is a safety precaution, in case the bulb breaks during the installation. The cup is deep enough to retain broken bulb glass without coming into contact with the hand of the user. The user never touches the glass tubing of the CFL. Removal is the reverse operation. The inventive feature of the internal cup spirals permits changing colors of cups on selected bulbs, e.g., to provide different mood lighting, different color spectrum for different seasons, parties and special occasions.

Figure 7:
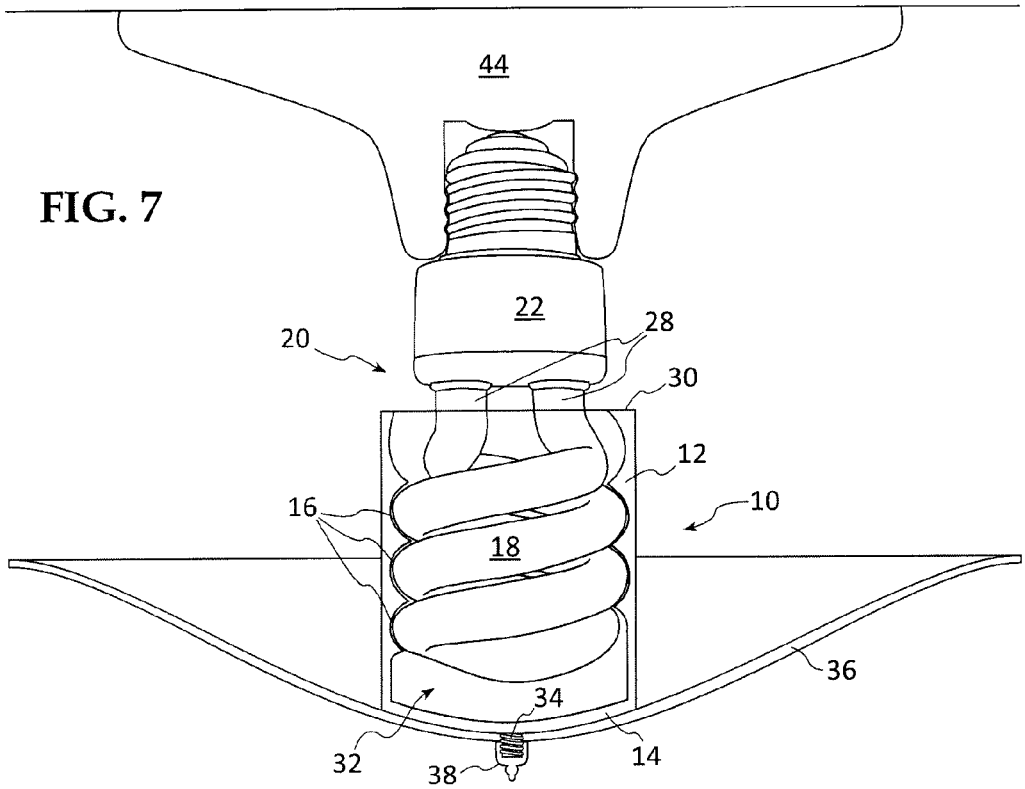
FIG. 7 is a side elevation, partly in section showing an alternative embodiment in which the inventive cup cover has a shade mounted thereon via an integral coupling.
Figure 8:
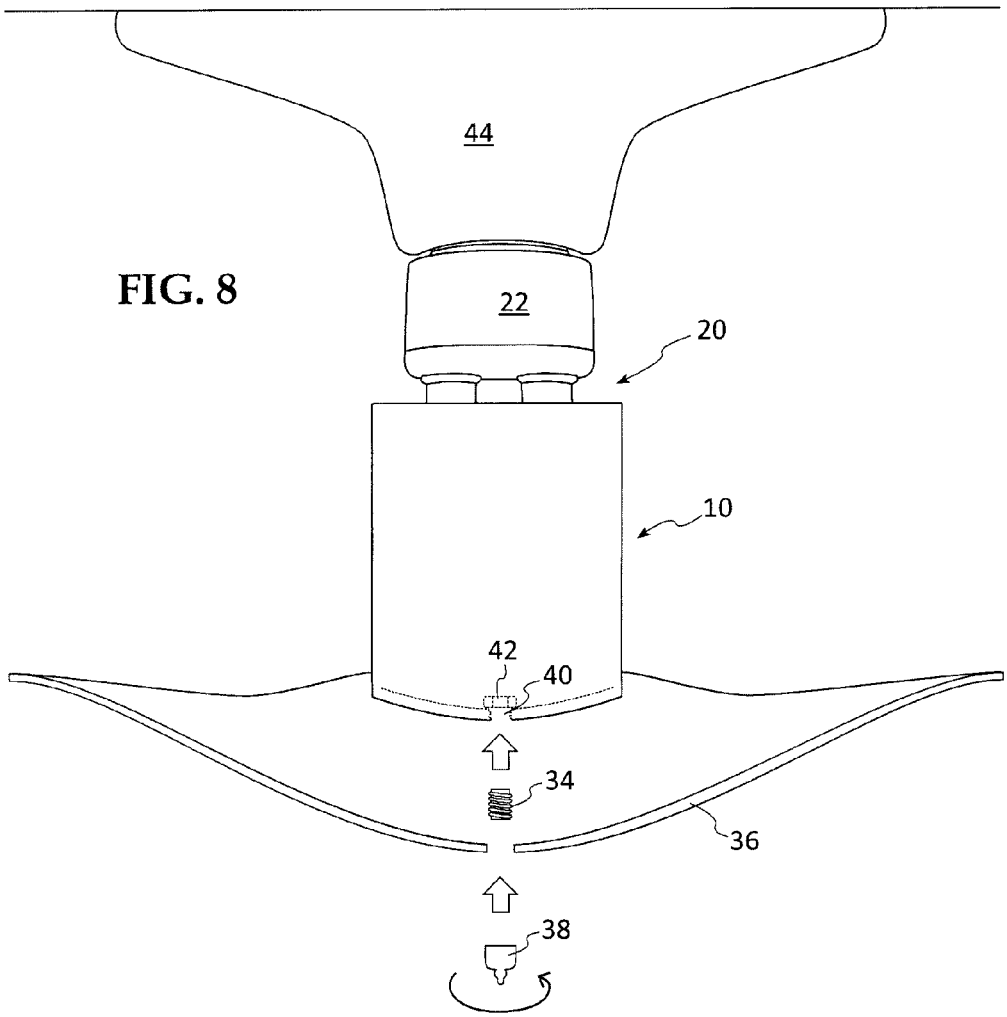
FIG. 8 is a side elevation showing a variation of the FIG. 7 embodiment in which the coupling is retrofit on the inventive cover cup.

In a second embodiment shown in FIGS. 7 and 8, the cup 10 is deeper than the height of the CFL tube spiral 18 so that there is a head space 32 between the top of the bulb and the inside face of the cup end dome wall 14. This permits installing a metal or plastic threaded coupling tube or rod 34 into the axial center of the cup from the outside end, over which is inserted a radially extending plastic, fabric, metal or glass shade 36 by use of a finial nut 38 screwed onto the projecting coupling.

There are two variations of this embodiment: A) where the threaded coupling is formed integral with the exterior of the cup end as shown in FIG. 7; and B) where the cup end is bored and threaded to receive a standard or provided tubular threaded coupling as a retrofit assembly, shown in FIG. 8. In the FIG. 8 variation of this embodiment, the coupling 34 is threaded into a cup end center hole 40, a keeper nut 42 is threaded on the coupling inside the cup, a shade 36 having a center hole or other cross-piece with a hole is placed over the exterior projecting end of the coupling and finally a finial 38 is threaded over the projecting coupling end.

These FIGS. 7 and 8 illustrate the use of the inventive cover 10 screwed on a spiral tube CFL 20 which is threaded into a ceiling-mounted receptacle 44.

Figure 9:
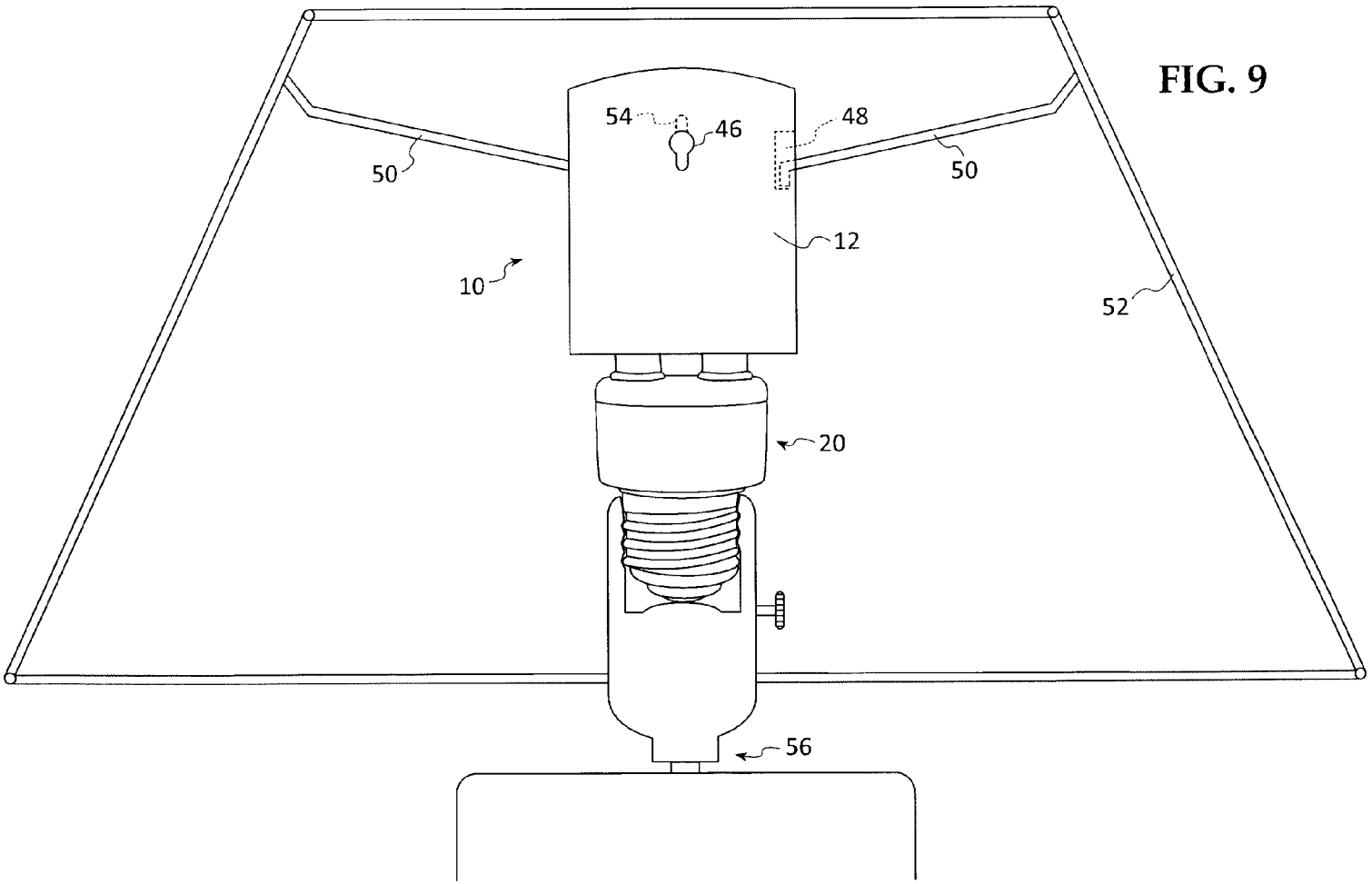
FIG. 9 is a side elevation of still another embodiment in which the cup side wall includes key holes or slots for receiving shade spoke hardware for retaining a shade on the inventive cup.

In a third embodiment shown in FIG. 9, the inventive cover 10, here a cup, includes key-hole or other shaped slots 46, 48 formed in (48) or through (46) the side wall 12 of the cup 10, into which stand-off ribs 50 of shade 52 are inserted for supporting or suspending a shade from the cup exterior. Optionally, a double-ended key hole slot 54 may be used, so that the cup is universally useful to retain a shade for a CFL bulb mounted in a lamp 56, or ceiling fixture 44 (see FIG. 8).

Figure 10:
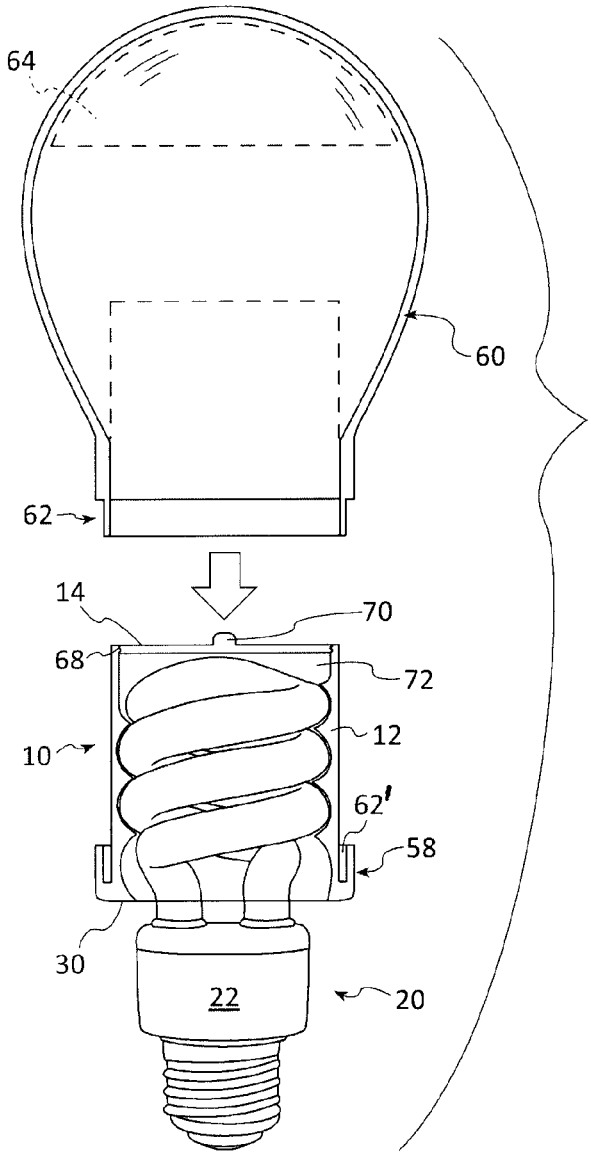
FIG. 10 is a side elevation partly in section showing still another embodiment of the inventive cup that can be converted to an open-ended sleeve, and may include an optional bulb-shaped outer cover element.

In a fourth embodiment shown in FIG. 10, the inventive cover 10 includes an upraised external flange 58 adjacent the open end 30 of the outer side wall face 12, and a separate decorative, hollow bulb-shaped cover element 60 comprising an enlarged bulb shell connected to a generally tubular open neck section, the neck being slipped over the cover 10 as shown by the arrow, so the thinned lower edge 62 of the bulb shell 60 engages and is retained by the groove 62' of flange 58. Optionally, the inside surface of the decorative bulb element may be partially silvered 64, which configuration is particularly useful for hanging lamps, such as dining table lamps, where the bulbs hang down, and the silvered "bottom" shields the eye, and redirects the light for indirect ceiling lighting.

Conversely, in the embodiment where the end cap 14 is threaded and removable by unscrewing via use of the knob 70, silvering the inside flights of the inventive sleeve 12 will result in a collimated tubular beam of light useful for task lighting.

Figure 11:
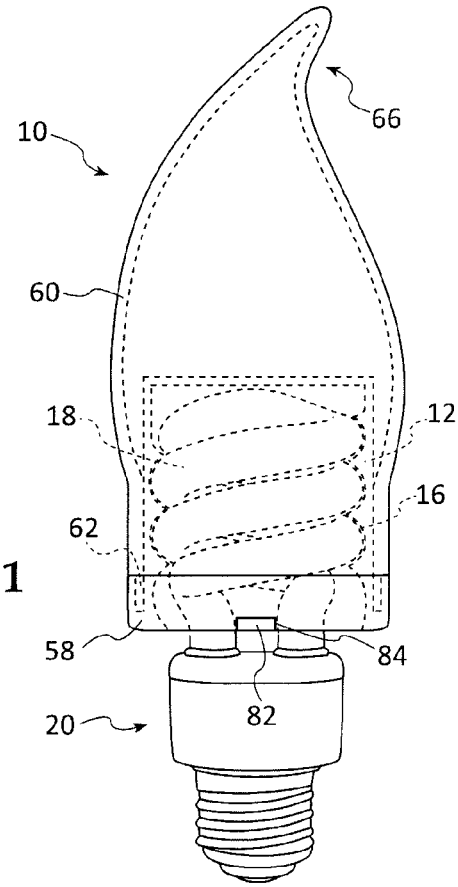
FIG. 11 is a side elevation showing another embodiment of the design cover in the form of a flame-type bulb shape.

In a fifth embodiment shown in FIG. 11, the separate decorative hollow bulb shaped shell 60 may be a "flame bulb" shape 66 to convert otherwise ugly screw-in spiral CFL bulbs to the more decorative flame bulb shape. The exterior of covers 60 may be subtly grooved and shaded or painted to mimic flames. This embodiment also illustrates a plastic or metal cross-piece keeper 82 that is press fit in diametrically opposed notches 84, or in the alternative may be glued across the open bottom end of the cup or sleeve member 12.

In a sixth embodiment shown in FIG. 10, the bottom, closed end 14 of the cup cover 10 may be removable, to form a true sleeve configuration, as the user determines for a particular usage. As shown, the end 14 includes threads 68 so the closure end may be selectively screwed-off by turning the raise finger ridge 70. The removal of the end piece 14 results in a generally conical spot of brighter light to emanate from the CFL 20 through the now-open end 72 of the inventive cover, while the sides remain diffuse when lighted, due to the presence of the sleeve screwed or slipped-onto the CFL tubing. Note that removal of outer end 14 converts the cup to a tubular sleeve.

While the embodiments of the inventive diffuser cups and sleeves have been described in connection with spiral-tube CFLs for screw-on use, one of ordinary skill in the plastic arts will recognize that it is straightforward to configure the inner walls of the inventive cups and sleeves with grooves matching the spacing, depth and tube sizes of the folded-tube type CFL bulbs so that they can be slipped-on or snapped-onto such type of CFLs.

Figure 12:
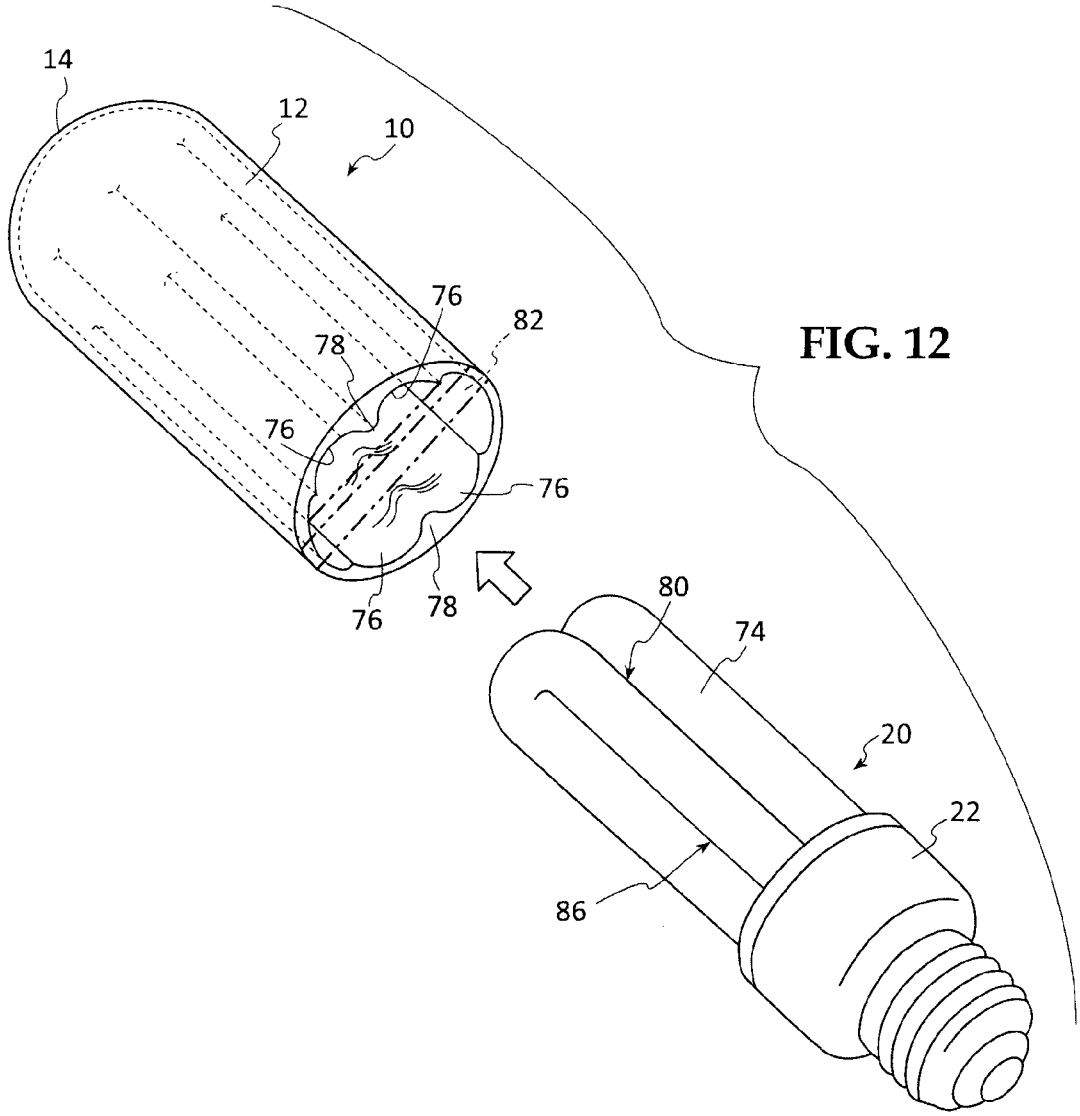
FIG. 12 is an exploded isometric view of the slip-on embodiment of the inventive cover for use with folded-tube type CFLs.

An example of this slip-on embodiment for CFLs having inverted U-shaped folded tubes 74 is illustrated in FIG. 12, wherein the interior surface of the tubular wall 12 inventive cover 10 is configured with shallow grooves 76, that are oriented parallel to and spaced from the center axis of the cover and the bulb and dimensioned to conform to the shape of the tubes 74. Grooves 76 grippingly slide over the axially parallel tubes 74 of the CFL 20 to retain the cover in place. An optional gripping rib 78 conforms to the gap 80 between the pairs of folded tubes 74. In the alternative, an optional cross member 82 may be secured across the diameter of the open end of the sleeve 12. This cross-member functions as a keeper, and fits in the gap 80 or 86 between the folds of tubes 74. The gap 80 is typically wider than 86, so the keeper 82 is dimensioned to fit whichever gap is selected.

Although FIG. 12 is an example showing a pair of folded tubes, it should be understood that the same principle can be applied to CFLs having three or more folded, axially oriented tubes. In general the inventive sleeves may be configured to receivingly engage CFL bulbs having compound light emitting tube shapes, typically spiral tubes, stacked circular tubes, folded tubes of various geometries, and the like. The inventive sleeves having one closed end form cups to permit safe no-hand-contact with the glass lighting tubular components of the glass CFL lighting tubular components (e.g., the spiral or folded glass tubes themselves), herein called "hands-free" installation, removal and handling.

Without intending to be limiting, the following are examples of the wide range of implementations possible for the transformation of relatively ugly CFL lighting tube elements into aesthetic diffusers: The plastic may be transparent and clear or tinted with a colorant dye, or may be translucent, e.g., a milky color produced by inclusion of an opacifier in the plastic composition; special effect fillers or coating materials may be used, e.g., fine fibers for a refractive effect, reflective chips for a sparkle effect, or an iridescent or frosted coating; the interior and/or internal surfaces may be textured, e.g., frosted in various degrees or grooved, or may have surface relief in a wide variety of designs; the exterior or interior may be coated, such as with a plastic-adherent paint with various designs; fluorescent or phosphorescent compounds may be included in the plastic composition for special effects; and the like.

In actual tests of dye tinted plastic, the light loss is minimal, and pleasing spectral shift is obtained. Thus, colors such as pale blue, rose, yellow, amber, green, lavender, red, and bastard amber dye colorants may be incorporated in the plastic to achieve more pleasing skin tones. The exterior surface in one embodiment includes sculpted axially parallel, radially spaced grooves, semicircular in cross section, the result being to refract and diffuse the light with essentially no loss of luminosity, yet with pleasing color balance shift for mood or space lighting.

INDUSTRIAL APPLICABILITY

It is clear that the inventive CFL bulb covers of this application has wide applicability to the lighting and home decor industry, including retrofit of spiral and folded tube fluorescent bulbs with decoratively pleasing diffusers. The inventive CFL bulb covers have a clear potential of becoming adopted as the new standard for safely handling mercury and phosphors containing CFL bulbs, and as pleasing light spectrum shifting diffusers and to aesthetically de-uglify CFL bulbs.

It should be understood that various modifications within the scope of this invention can be made by one of ordinary skill in the art without departing from the spirit thereof and without undue experimentation. For example, the external shape 12 of the inventive covers 10 can have a wide range of designs to provide the functionalities disclosed herein. Likewise the covers may be used in either sleeve-type or cup-type configurations. As bulb design changes in the future by provision of glass light emitting tubular shapes, the inventive sleeves can be easily configured to be retainingly engaged by these new shapes. This invention is therefore to be defined by the scope of the appended claims as broadly as the prior art will permit, and in view of the specification if need be, including a full range of current and future equivalents thereof.

APPENDIX A

Parts List

Parts List (This Parts List is provided as an aid to Examination and may be canceled upon allowance)

| | |
|---|---|
| 10 | Inventive cover |
| 12 | Tubular sleeve |
| 14 | Closed outer end |
| 16 | Interior threads |
| 18 | Spiral tube |
| 20 | CFL |
| 22 | Base of CFL |
| 24 | Exterior surface |
| 26 | Edge intersection of dome and wall |
| 28 | Stems of bulb |
| 30 | Open end of cup |
| 32 | Head space |
| 34 | Coupling tube or rod |
| 36 | Shade |
| 38 | Finial nut |
| 40 | Hole in end of cup 14 |
| 42 | Keeper nut |
| 44 | Ceiling mounted receptacle |
| 46 | Keyhole slot - through |
| 48 | Keyhole slot in side wall |
| 50 | Stand off rib |
| 52 | Shade |
| 54 | Double-ended keyhole slot |
| 56 | Lamp |
| 58 | External flange & groove 62 |
| 60 | Hollow bulb element |
| 62 | Thin edge; 62' Perimeter groove in flange 58 |
| 64 | Partial silvering |
| 66 | Flame tip |
| 68 | Threads |
| 70 | Finger ridge |
| 72 | Open top of cover sleeve |
| 74 | Folded-tube type CFL |
| 76 | Spaced shallow grooves conform to tube shape |
| 78 | Gripping Rib (optional) |
| 80 | Gap between folded tube pairs |
| 82 | Cross-piece keeper |
| 84 | Notch for cross-piece 82 |
| 86 | Gap between folded tubes, transverse to 80 |
| 88 | Part Line for snap-together halves |
| 90 | Inter-engaging shoulders of halves |
| 92 | |
| 94 | |
| 96 | |
| 98 | |
| 100 | |

The invention claimed is:

1. A light diffusion and safety sleeve assembly for a CFL bulb having lighting tubular components extending outwardly from one end of a base member, said base member including electrical contact members for receiving power to provide light, comprising in assembled operative configuration:

a) a formed body having a continuous side wall with an inner surface and an outer surface spaced radially outwardly therefrom to form a generally cylindrical, geometrically tubular shape having a central axis, a first end and a second end;

b) a bottom wall closing said tubular shape at said first end to form an end cap;

c) said second end of said tubular shape being open to receive therein at least one of said lighting tubular components of said CFL bulb;

d) said inner surface that is contoured or grooved to match the shape of said CFL bulb tubular components shape so that said body is receivingly engaged by said lighting tubular component;

e) said side wall being substantially equal in axial length to the outward extent of said lighting tubular components so that when said body is secured to said CFL bulb, said lighting tubular components are essentially hidden by said body; and f) said body being composed of a transparent or translucent plastic or glass material that diffuses the light from said lighting tubular components and is resistant to heat generated by said CFL bulb in operation;

g) said formed body having a closed end as an assembly providing a safety cup to permit installation, removal and handling of the CFL bulb without having to touch the bulb lighting tubular components, while permitting retaining glass shards of said lighting tubular components when said bulb becomes broken thereby minimizing injury and exposure to hazardous phosphor and mercury coating components of said CFL bulbs.

2. A light diffusion and safety sleeve assembly for a CFL bulb as in claim 1 wherein said inner surface is contoured in a negative spiral to correspond to and co-operatingly engage spiral flights of the lighting tubular components of a spiral CFL bulb, thereby permitting said sleeve to be retainingly installed on said bulb by screwing it onto and over said spiral tubular components of said bulb.

3. A light diffusion and safety sleeve assembly for a CFL bulb as in claim 1 wherein said inner surface is contoured with axially parallel grooves to correspond to and co-operatingly engage folded tubes of a folded-tube type CFL bulb, thereby permitting said sleeve to be retainingly installed on said bulb by slipping it onto and over said folded tube components of said bulb.

4. A light diffusion and safety sleeve assembly for a CFL bulb as in claim 2 wherein said exterior surface is configured with at least one of surface relief, texture or design.

5. A light diffusion and safety sleeve assembly for a CFL bulb as in claim 3 wherein said exterior surface is configured with at least one of surface relief, texture or design.

6. A light diffusion and safety sleeve assembly for a CFL bulb as in claim 4 wherein said body is composed of plastic.

7. A light diffusion and safety sleeve assembly for a CFL bulb claim 5 wherein said body is composed of plastic.

8. A light diffusion and safety sleeve assembly for a CFL bulb as in claim 6 wherein said plastic is transparent.

9. A light diffusion and safety sleeve assembly for a CFL bulb as in claim 7 wherein said plastic is transparent.

10. A light diffusion and safety sleeve assembly for a CFL bulb as in claim 8 wherein said plastic is tinted with a colorant.

11. A light diffusion and safety sleeve assembly for a CFL bulb as in claim 9 wherein said plastic is tinted with a colorant.

12. A light diffusion and safety sleeve assembly for a CFL bulb as in claim 8 wherein said exterior surface is configured in a manner selected from texture, coating, relief design, or sculpted geometric designs.

13. A light diffusion and safety sleeve assembly for a CFL bulb as in claim 9 wherein said exterior surface is configured in a manner selected from texture, coating, relief design, or sculpted geometric designs.

14. A light diffusion and safety sleeve assembly for a CFL bulb as in claim 1 which includes a CFL bulb receivingly engaged in said sleeve assembly.

15. A light diffusion and safety sleeve assembly for a CFL bulb as in claim 1 which includes a shade assembly removably securable or permanently secured to an exterior surface of said sleeve.

16. A light diffusion and safety sleeve assembly for a CFL bulb as in claim 15 wherein said shade assembly is removably securable to said bottom wall end cap.

17. A light diffusion and safety sleeve assembly for a CFL bulb as in claim 1 wherein said sleeve is made in two halves along a part line comprising the intersection of a plane including the axis of said sleeve and diametrically opposed sections of said side wall.

18. A light diffusion and safety sleeve assembly for a CFL bulb as in claim 1 wherein said sleeve is configured to receive thereover a plastic or glass bulb element having an enlarged bulb-shaped section and an open neck section, said bulb element being secured to said sleeve by co-operatingly mating shoulders disposed adjacent the open neck and open second end of said sleeve.

19. A light diffusion and safety sleeve assembly for a CFL bulb as in claim 1 wherein said bottom end cap is selectively removable to provide a light pattern in the form of a beam, and said interior surface is selectively silvered to reflect light in said beam.

20. A light diffusion and safety sleeve assembly for a CFL bulb as in claim 18 wherein at least a portion of the interior of said glass bulb element is silvered to reflect light in a manner to provide indirect lighting.

* * * * *

UNITED STATES PATENT AND TRADEMARK OFFICE

CERTIFICATE OF CORRECTION

PATENT NO. : 8,242,667 B2
APPLICATION NO. : 13/014775
DATED : August 14, 2012
INVENTOR(S) : Karl L. Gruber It is certified that error appears in the above-identified patent and that said Letters Patent is hereby corrected as shown below:

Title Page Item (54) and Column 1, line 1, the Title is corrected to read "Folded and Spiral CFL Bulb Safety Cups, Diffusion Covers and Shade Assemblies".

Signed and Sealed this
Twenty-fifth Day of September, 2012

David J. Kappos

David J. Kappos
*Director of the United States Patent and Trademark Office*